US007021264B2

(12) United States Patent
Giffin

(10) Patent No.: US 7,021,264 B2
(45) Date of Patent: Apr. 4, 2006

(54) VARIABLE VALVE

(75) Inventor: John Giffin, 452 Santa Mesa Dr., San Jose, CA (US) 95123

(73) Assignee: John Giffin, San Jose, CA (US)

( * ) Notice: Subject to any disclaimer, the term of this patent is extended or adjusted under 35 U.S.C. 154(b) by 0 days.

(21) Appl. No.: 10/808,673

(22) Filed: Mar. 24, 2004

(65) Prior Publication Data

US 2004/0177831 A1 Sep. 16, 2004

Related U.S. Application Data

(63) Continuation-in-part of application No. 10/348,357, filed on Jan. 21, 2003, now Pat. No. 6,712,040.

(51) Int. Cl.
*F02D 9/08* (2006.01)

(52) U.S. Cl. ..... 123/184.55; 123/336

(58) Field of Classification Search ..... 123/184.53, 123/184.56, 336, 337, 80 BA, 190.1, 190.11
See application file for complete search history.

(56) References Cited

U.S. PATENT DOCUMENTS

| | | | | |
|---|---|---|---|---|
| 1,222,941 | A | 4/1917 | Egoroff | |
| 1,448,055 | A | 3/1923 | Corti | |
| 3,659,572 | A * | 5/1972 | Pelizzoni | 261/41.1 |
| 5,315,962 | A * | 5/1994 | Renault et al. | 123/190.11 |
| 5,845,677 | A | 12/1998 | Kim | |
| 6,712,040 | B1 * | 3/2004 | Giffin | 123/336 |
| 2005/0139192 | A1 * | 6/2005 | Lechner | 123/336 |

OTHER PUBLICATIONS

Andy Pycock-Project Manager; Swindon Racing Engines; Swindon, Wilshire; Formula 3 Engine 2002; Issue 1 ; www.swindon-engines.com.
Andy Pycock-Project Manager; Swindon Racing Engines; Swindon, Wilshire Formula 3 Engine 2002; Issue 2; www.swindon-engines.com.
Rally Action; The Road to Dakar 2005—8 Days to Go Dec. 23, 2004; www.rally-action.com.
BDG Customer Parts Unit; Welshpool WA, Australia; www.custom@bdg.com.au.

* cited by examiner

*Primary Examiner*—Hai Huynh
(74) *Attorney, Agent, or Firm*—Michael A. Glenn; Glenn Patent Group

(57) ABSTRACT

A variable valve comprising a first cylinder having an aperture and a second cylinder having a second aperture. The first cylinder moves between a first position and a second position. Preferably, the second cylinder moves in cooperation with the first cylinder such that the first aperture and the second aperture form a variable sized opening when the first cylinder moves from the first position toward the second position. The first aperture and the second aperture preferably rotate. The variable sized opening is preferably in a closed position when in the first position. The valve comprises a block body including a passage for allowing air to pass therethrough. The first cylinder and the second cylinder are coupled to the block body and configured in a predetermined position such that the variable sized opening is in communication with the passage. The valve also includes an axle for driving the first cylinder and the second cylinder.

65 Claims, 9 Drawing Sheets

VARIABLE VALVE

This application is a Continuation-In-Part Application, which claims priority from U.S. application Ser. No. 10/348,357, filed 21 Jan. 2003, issued on 30 Mar. 2004 as U.S. Pat. No. 6,712,040, entitled VARIABLE THROTTLE VALVE, which is incorporated herein by reference.

BACKGROUND OF THE INVENTION

1. Field of the Invention

The present invention relates to an apparatus for regulating flow through a passage. More particularly, the present invention relates to a rotary valve.

2. Description of Related Art

Spark ignition internal combustion engines often employ a butterfly valve in a throttle valve assembly to control air intake. While a butterfly valve works adequately, the horsepower can be increased if the valve employed in the throttle assembly is less restrictive, since the butterfly valve shaft and the plate remain in the airflow path, obstructing airflow while in open throttle. In the past, slide throttles, pivoting variable intakes and other means have been used to reduce restriction in the intake path. An important consideration in the design of non-butterfly intake valves is airflow control, turbulence and low throttle response. Because of their long use and development, butterfly intake valves have been developed which adequately address those issues, but many non-butterfly systems still present problems in partial throttle situations. One non-butterfly intake control type utilizes barrel valves which rotate between a closed position and an open position. However, known barrel valve systems have numerous limitations and disadvantages compared to butterfly systems at partial throttle openings. The present invention solves these and other problems previously encountered with barrel valve intake systems.

SUMMARY OF THE INVENTION

The present invention is for variable area which employs at least two barrels which are parallel to one another and rotate in synchronization with one another. The barrels contain openings perpendicular to their rotational axes which mate at the interface of the barrels so that they can create an opening perpendicular to the barrels which is concentric with a port in a manifold or valve body. The openings in each barrel provide an opening of a desired size at an open position and a predetermined minimum size at a closed position. The closed position can also be a completely closed position to cut off flow entirely. Once benefit of the invention is that the openings in the barrel may be sized so that they can match non-circular manifold openings.

A further benefit of the present invention is that the openings can be sized and the gearing between barrels chosen, so that the intake area at intermediate settings is a nonlinear function of control setting applied to the barrel valves. In this way, tuning of the system can be varied to obtain a desired response.

In one aspect, the invention is a variable aperture valve comprising a first cylinder having a first aperture and a second cylinder having a second aperture. The first cylinder moves between a first position and a second position. The second cylinder moves in cooperation with the first cylinder such that the first aperture and the second aperture form a variable sized opening when the first cylinder moves from the first position towards the second position. The variable sized opening is in a relatively closed position when in the first position. The valve comprises a block body including a passage for allowing air to pass therethrough. The first cylinder and the second cylinder are coupled with the block body and configured in a predetermined position such that the variable sized opening is in communication with the passage. The valve also includes an axle for driving the first cylinder and the second cylinder.

In one presently preferred embodiment of the invention, a variable valve comprises a first cylinder having a first aperture, wherein the first cylinder moves between a first position and a second position. A second cylinder has a second aperture. The second cylinder moves between the first position and the second position such that the first aperture and the second aperture form a variable sized opening when the first cylinder and the second move from the first position toward the second position, the second cylinder moving in cooperation with the first cylinder. The valve further comprises a gear assembly having a first set of gears coupled to the first cylinder and the second of gears coupled to the second cylinder. The first set of gears sand the second set of gears are geared to one another. The variable sized opening is in a closed position when the first cylinder and the second cylinder are in the first position. The valve further comprises a block body which includes a passage for allowing air to pass through the block body. The first cylinder and the second cylinder are coupled to the block body and configured in a predetermined position. The variable sized opening is in communication with the passage. The valve further comprises an axle for driving the first cylinder and the second cylinder. The axle is coupled to the block body. The first cylinder and the second cylinder move in an opposite direction from one another or in a same direction with one another. In a currently preferred embodiment, the first cylinder and the second cylinder rotate on respective axes which are parallel to one another.

In another aspect of the invention, a variable valve apparatus comprises a body; a first rotatable cylinder and a second rotatable cylinder coupled to the body. The first rotatable cylinder is coupled to the body and has a first aperture cut therethrough. The second rotatable cylinder has a second aperture cut therethrough. The second rotatable cylinder is configured to rotate in an opposite direction from the first rotatable cylinder, whereby the first aperture and the second aperture form a variable sized opening. The first aperture and the second aperture do not form the opening when the first rotatable cylinder is in a closed position. The body further comprises a passage for allowing air to pass through the body. The first rotatable cylinder and the second rotatable cylinder are coupled to the body and configured in a predetermined position such that the opening is in communication with the passage. The valve apparatus further comprises an axle for driving the first rotatable cylinder and the second rotatable cylinder, wherein the axle is coupled to the body. The valve apparatus further includes a gear assembly having a first set of gears coupled with the first rotatable cylinder and a second set of gears coupled to the second rotatable cylinder. The first sent of gears and the second set of gears are geared to one another. In a currently preferred embodiment, the first rotatable cylinder and the second rotatable cylinder rotate in an opposite direction from one another. Alternatively, the first rotatable cylinder and the second rotatable cylinder may rotate in the same direction as one another.

In another aspect of the invention, a variable throttle valve apparatus comprises a body having a passage. A first cylinder is coupled to the body. The first cylinder has a first aperture and is configured to be moved between a first position and a second position. A second cylinder is coupled to the body. The second cylinder has a second aperture and is configured to be moved between the first position and the second position, such that he first aperture and the second aperture form a variable sized opening when the first cylinder and the second cylinder move between the first position and the second position. The variable sized opening is preferably in a closed position when the first cylinder and the second cylinder are in the first position. The body is configured to allow a predetermined amount of air to pass through the passage as the cylinders rotate from a first position to a second position. The body is configured to mate with the variable opening so as to allow a desired amount of air to pass through the passage when in the first position. The valve apparatus further comprises an axle for driving the first cylinder and the second cylinder, wherein the axle rotates in the body. The valve apparatus further comprises a gear assembly having a first set of gears that are coupled to the first cylinder. A second set of gears is coupled to the second cylinder, wherein the first sent set of gears and the second set of gears are geared to one another. The first cylinder and the second cylinder are configured to rotate in cooperation with one another, whereby the first aperture and the second aperture form a variable sized opening between the first position and the second position.

In yet another aspect of the invention, a method of assembling a variable valve apparatus comprises providing a body having a conduit, wherein the conduit is configured to have an open position and a closed position. The method comprises rotatably inserting a first cylinder into the body. The first cylinder has a first aperture and is configured to be moveable such that the first aperture is in complete communication with the conduit in the open position. The method further comprises rotatably inserting a second cylinder into the body. The second cylinder has a second aperture and is configured to be moveable such that the second aperture is in complete communication with the conduit in the open position. The first aperture and the second aperture are not in communication with the conduit when the first aperture and the second aperture are in the closed position. The body includes means for driving the first cylinder and the second cylinder, wherein the means for driving is attached to the body. The body further comprises a gear assembly which has first set of gears coupled to the first cylinder and a second set of gears coupled to the second cylinder, wherein the first set of gears and the second set of gears are geared to one another. The first cylinder and the second cylinder preferably move in an opposite direction from one another. The first and the second cylinders are preferably rotatably moveable about axes which are parallel to one another.

In yet another aspect, a valve comprises a body, a first means for channeling air through the body, and a second means for channeling air through the body. The first means and the second means are configured to rotatably more in an opposite direction from one another, thereby forming a variably sized aperture.

From the above, it may be seen that the present invention provides a means of configuring intake systems for intake combustion engines which have important advantages over butterfly valves. For example, the intake valve system may be configured for a non-circular opening at a wide open throttle, thereby being more easily mated to multi valve cylinder heads, which often do not have circular intake ports. Also, since the apertures in the cylinders may be easily varied in cross-section, it is possible to have different cross-section to rotation angles to tune the intake system as a function of throttle opening.

While the invention has been described in the context of an internal combustion intake throttle, those skilled in the art will also recognize that the principles of the engine may be applied to a variety of valve systems for engines and commercial processes and applications.

Other features and advantages of the present invention will become apparent after reviewing the detailed description of the preferred embodiments set forth below.

DETAILED DESCRIPTION OF THE PREFERRED EMBODIMENT

The present invention provides many benefits over prior art valve systems and may also be applied to other non-engine applications in which it is desirable to have a robust variable opening valve. While the invention will be described in a presently preferred embodiment in which the opening in the valve in a fully open position has a circular cross-section, the valve may be configured to have a non-circular cross section at a wide open position for various applications. Similarly, while the embodiments which are described illustrate a fully closed position and direct one to one gearing, both the gearing and the cylinder cross section may be changed to provide different minimum throttle openings and slopes of area vs. throttle inputs as desired.

Reference will now be made to preferred and alternative embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide an understanding of the present invention. However, it should be noted that the present invention may be practiced without these specific details. In other instances, well known methods, procedures and components have not been described in detail as not to unnecessarily obscure the aspects of the present invention.

Figure 1:
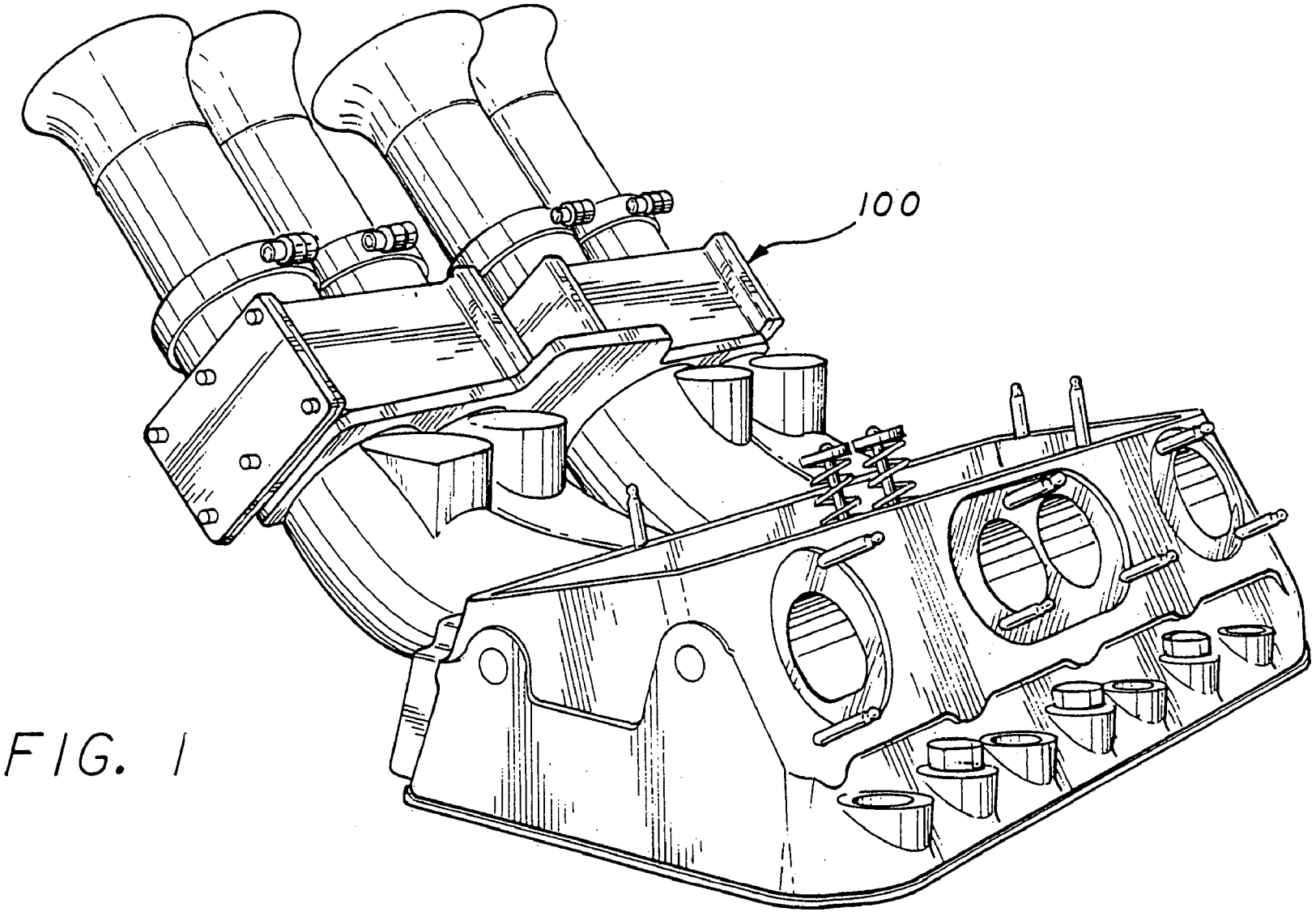
FIG. 1 is a perspective view of an intake valve system according to the invention mounted on an engine cylinder head.

FIG. 1 is a perspective view of a valve body 100 according to the invention mounted on a cylinder head of an internal combustion engine.

Figure 1A:
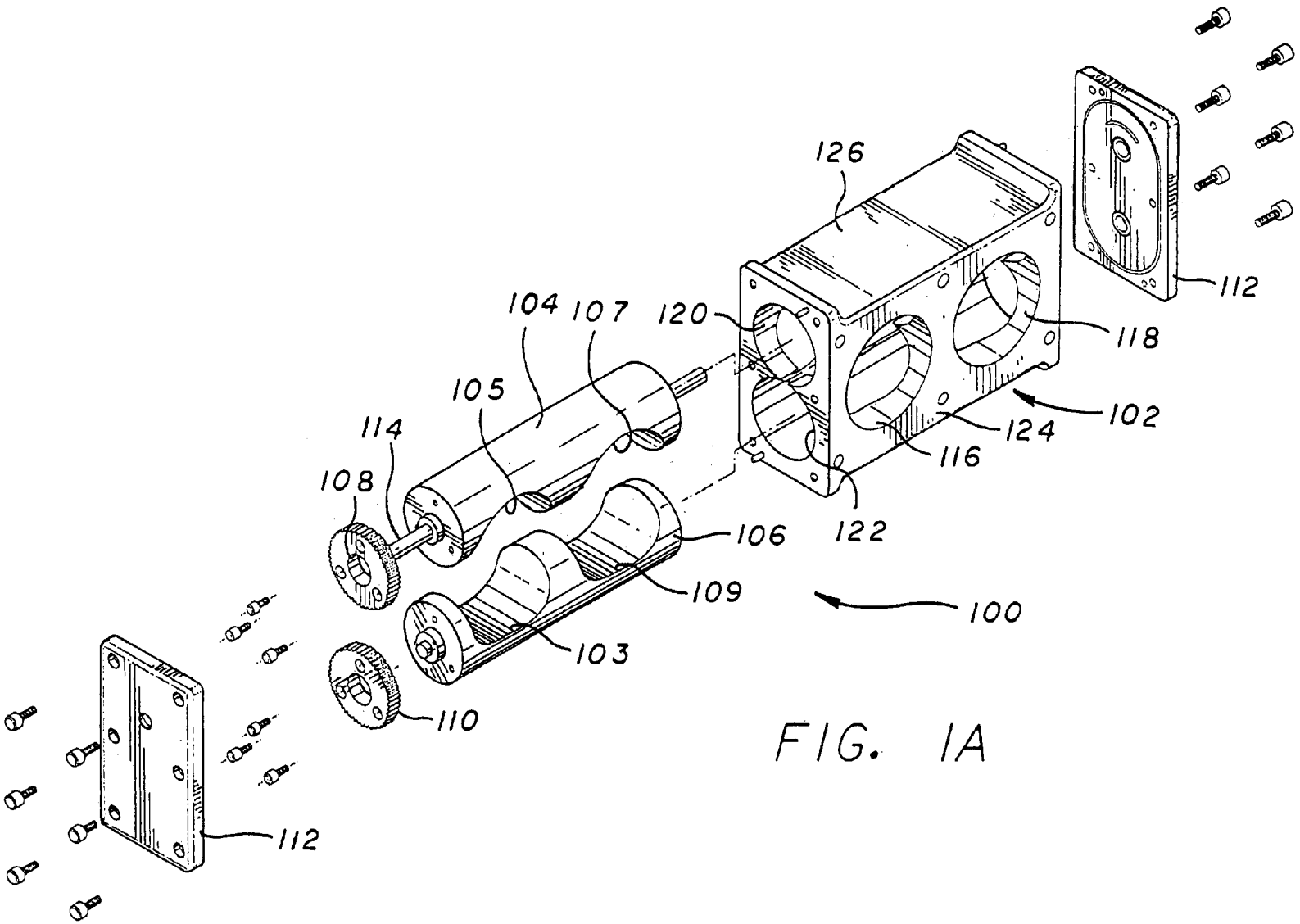
FIG. 1A illustrates and exploded view of the variable valve according to a preferred embodiment of the present invention.

FIG. 1A illustrates an exploded view of the variable valve 100 according to the preferred embodiment of the present invention. The variable valve 100 includes a block or body 102, a first cylinder or barrel 104 coupled to the body 102 and a second cylinder or barrel 106 coupled to the body 102. In addition, the valve 100 includes a first gear 108, a second gear 110, a side piece 112 and an axle 114. Similarly, the second gear 110 is coupled to the second cylinder 106 and also coupled to a bearing set (not shown) configured in the inner side of the side piece 112. The axle 114 is preferably coupled to the first cylinder 104, whereby the axle 114 extends through the side piece and the first gear 108 to the first barrel 104. Alternatively, the axle 114 is coupled to the second barrel 106.

As shown in FIG. 1A, the block 102 includes several apertures. On the front face of the block 102 is a first opening or passage 116 and a second opening or passage 118. The first passage 116 extends from the front face 124 to the back face 126. Similarly, the second passage 118 extends from the front face 124 to the back face 126 of the block 102. The preferred embodiment shown includes two passages, such as to support different types of induction intake systems. The block 102 includes two side inserts 120 and 122, wherein the first barrel 104 couples to the first insert 120 and the second barrel 106 couples to the second insert 122.

As shown in FIG. 1A, the first gear 108 couples to the first barrel 104 and the second gear 110 couples to the second barrel 106. Preferably, the first gear 108 and the second gear 110 are of the same size and dimension. Alternatively, the first gear 108 and the second gear 110 are of a different size and dimension. When the barrels 104 and 106 are positioned within the block 102, the first gear 108 and the second gear 110 are geared together such that the rotation of one of the barrels will cause the other barrel to rotate in cooperation with the barrel. Although only two gears 108, 110, are shown in this example, more than two gears may be used in the event that a gear train of a different ratio is used. Alternatively, the barrels may be driven by other means, such as levers, electromechanical stepper motors or the like to accomplish the appropriate synchronized opening.

Figure 1B:
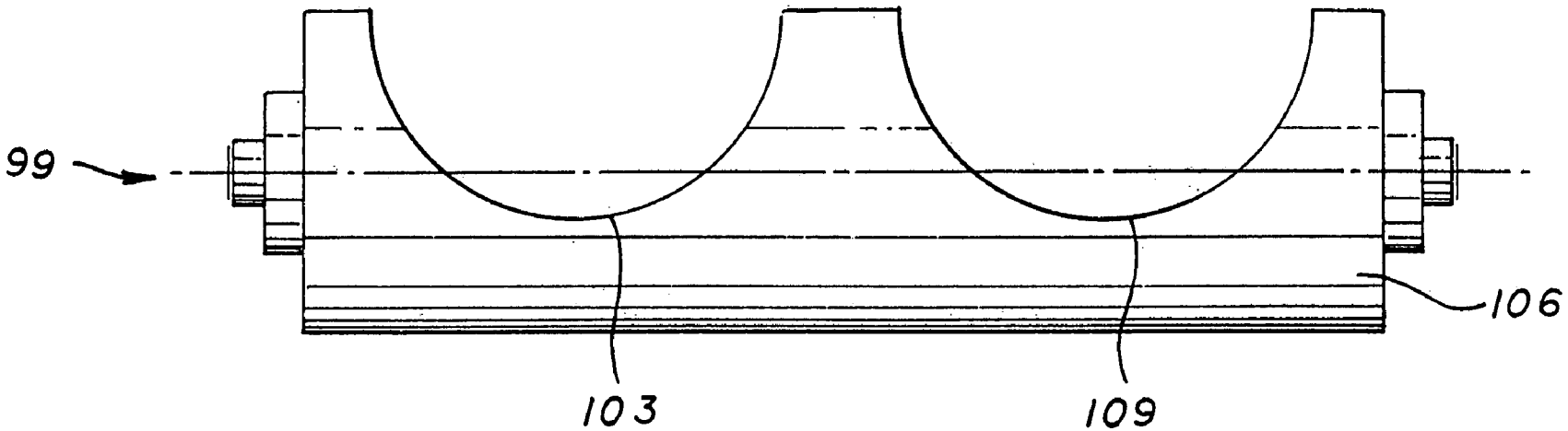
FIG. 1B illustrates a perspective view of one of the cylinder used in the variable valve according to the preferred embodiment of the present invention.

FIG. 1B illustrates a perspective view of one of the cylinders 106 used in the variable valve according to the preferred embodiment of the present invention. The barrel or cylinder 106 preferably includes a first aperture 103 and second aperture 109. Alternatively, the number of apertures would depend on the number of passages that are present in the block, if a block is used in the valve apparatus. Alternatively, if a block is not used, the number of apertures would depend on the number of valves that are desired. The aperture 103 serves as an opening through which flow passes through. Preferably, the flow would be an air flow. Alternatively, the flow would be some other medium, such as other gases or even liquids. The aperture 103 is preferably a semicircular shape to conform to the shape of the passage 116 in the block 102. Alternatively, the aperture 103 is any other shape or pattern, such as square, rectangular, etc. The cylinder 106 includes an axis 99 that passes through the length of the cylinder 106, whereby the cylinder 106 is configured to rotate about the axis 99.

Figure 2A:
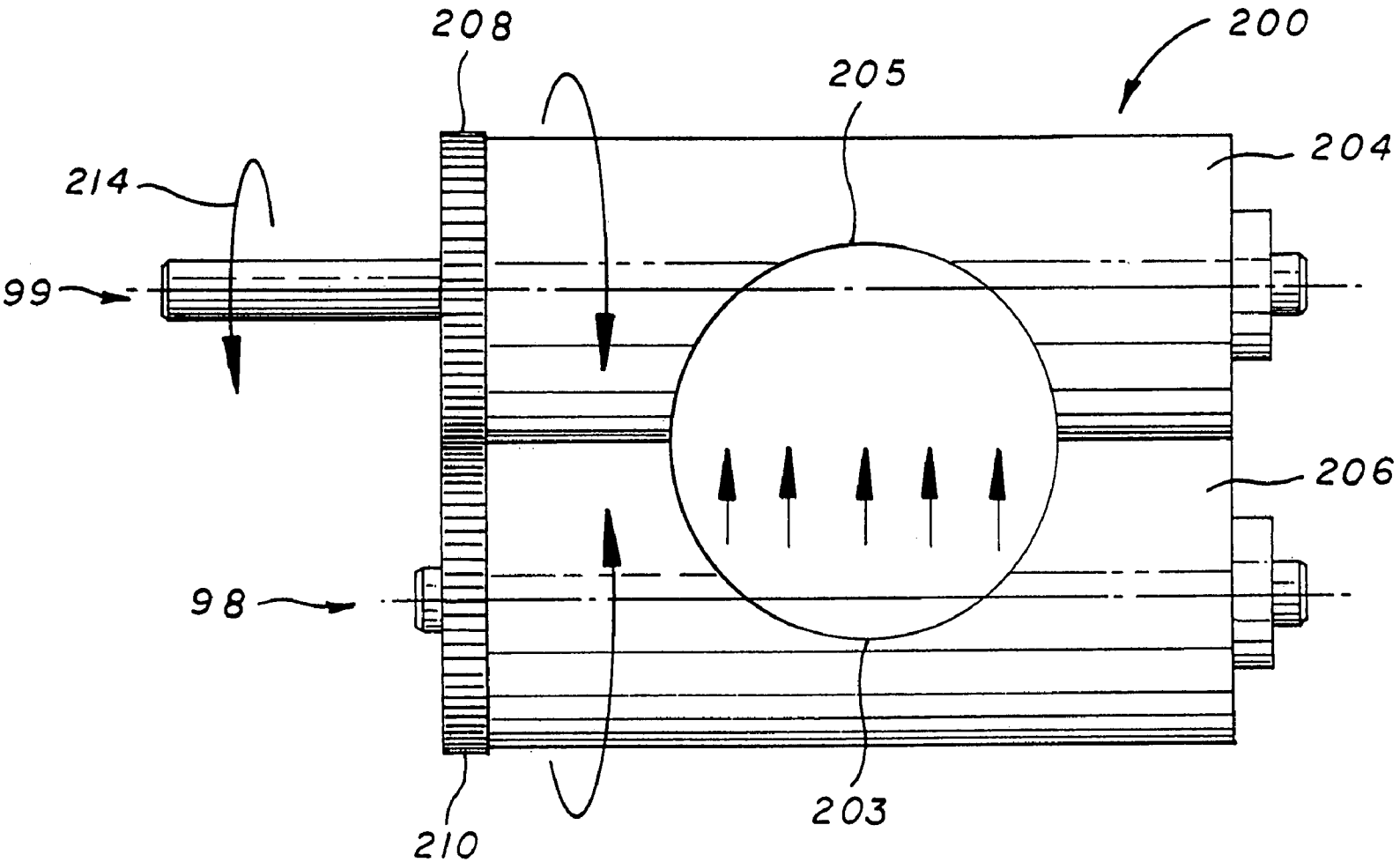
FIG. 2A illustrates a perspective view of the variable valve in an open position according to the alternative embodiment of the present invention.

FIG. 2A illustrates a perspective view of the variable valve in an open position according to the present invention. It should be noted that he block 102 has been omitted from FIGS. 2A–2C for illustration purposes, although it is not necessary that block 102 be used to practice the present invention. As shown in FIG. 2A, the barrels 204 and 206 are positioned such that the semi-circular apertures 203 and 205 form a channel or conduit which is a complete circular aperture. The channel is designated as being in the open position, because the maximum amount of flow passes through the channel. The first gear 208 and the second gear 210 are coupled to one another such that the rotation of one of the barrels will cause the other barrel to rotate in cooperation with the barrel. The rotation of the first barrel 204 causes the second barrel 206 to also rotate, thereby allowing the circular aperture to increase or decrease in dimension or diameter as the barrels rotate.

For instance, as shown in FIG. 2A, the valve 200 is shown in the open position. Applying a torque force to the axle 214 will cause the axle 214 to rotate. As shown in FIG. 2A, the rotation is preferably provided in a clockwise manner. It should be noted that the axle 214 alternatively rotates in a counter-clockwise manner. Once the axle 214 rotates clockwise, the first barrel 204 also begins to rotate clockwise about axis 99. Since the first gear 208 is coupled to the first barrel 204 and also geared to the second gear 210, the second gear 210 will rotate counter-clockwise along axis 98. As described above, the second gear 210 is coupled to the second barrel 206, therefore the second barrel 206 rotates counter-clockwise as the first barrel 204 rotates clockwise. The rotation of the first barrel 204 and the second barrel 206 causes the complete circular aperture to change in dimension, as shown in FIG. 2B.

Figure 2B:
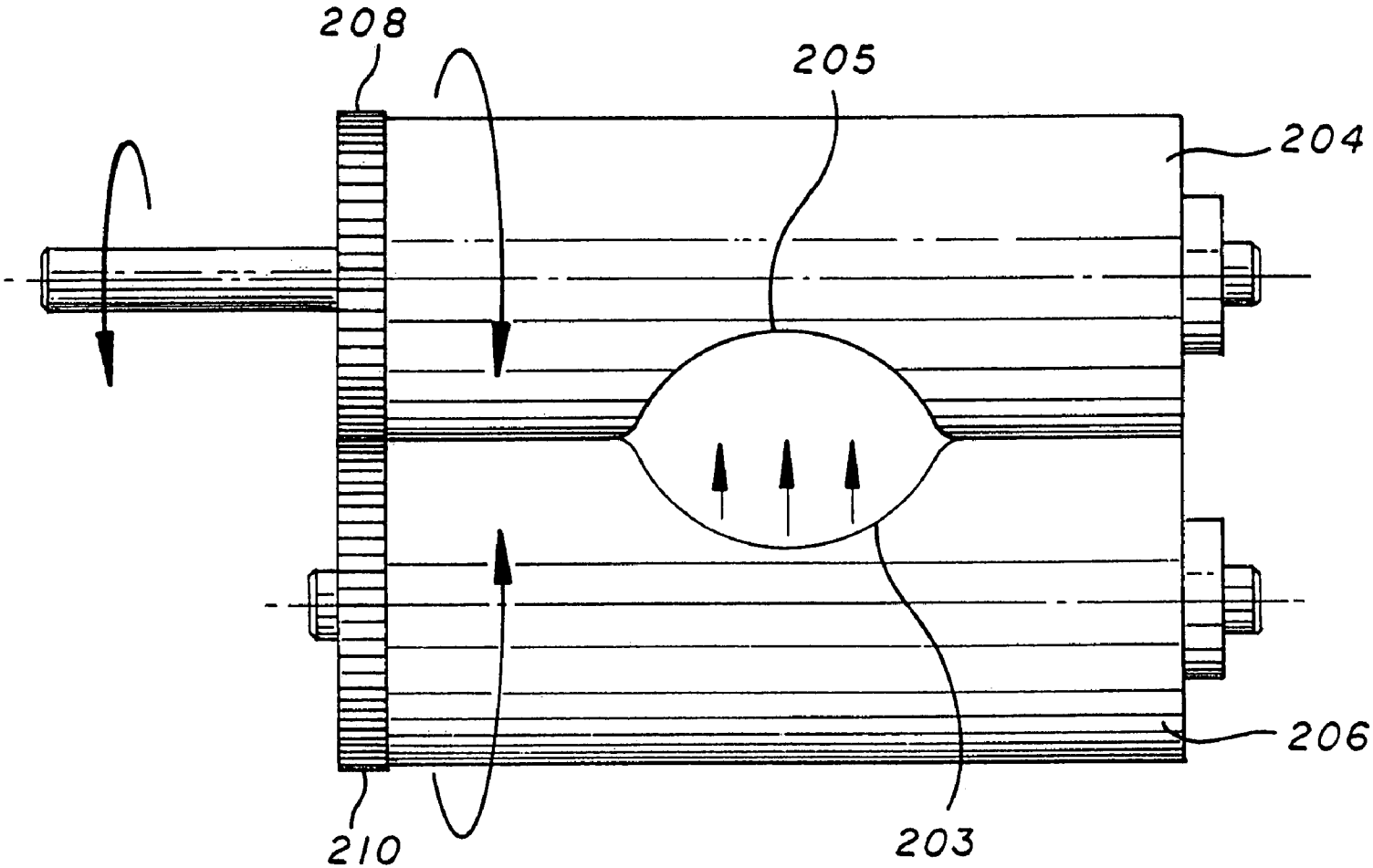
FIG. 2B illustrates a perspective view of the variable valve in an intermediate position according to the alternative embodiment of the present invention.
Figure 2C:
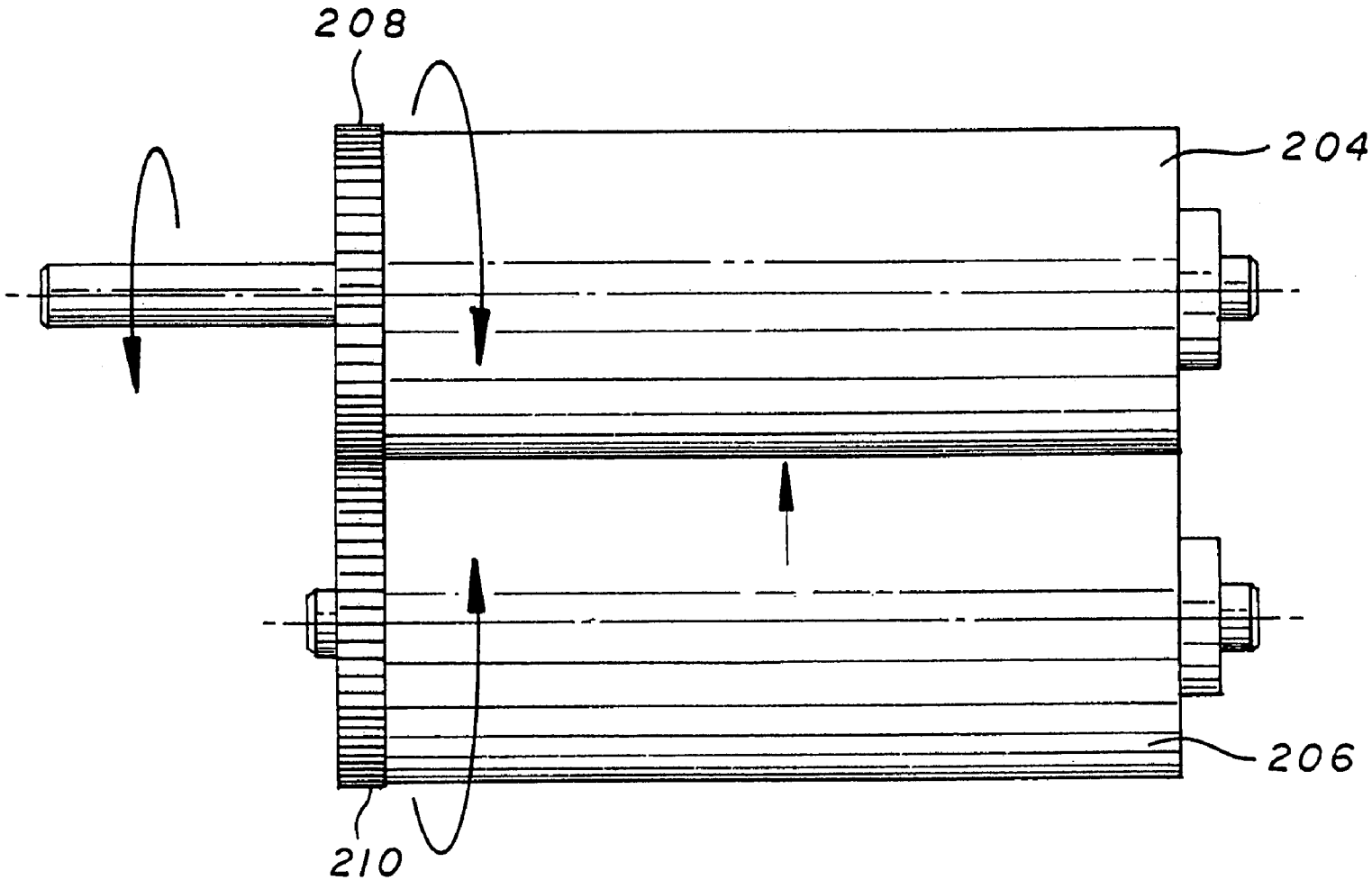
FIG. 2C illustrates a perspective view of the variable valve in a closed potion according to the alternative embodiment of the present invention.

FIG. 2B illustrates a perspective view of the variable valve in an intermediate position according to the present invention. As the first barrel 204 rotates in the clockwise manner and the second barrel 206 rotates in a counter-clockwise manner, the dimension of the channel decreases in size. This decrease in dimension prevents the maximum amount of flow to pass through the channel. Further, as shown in FIG. 2C, the variable valve 200 is in a closed position as the first barrel 204 and the second barrel 206 rotate opposite of one another even further.

Figure 3A:
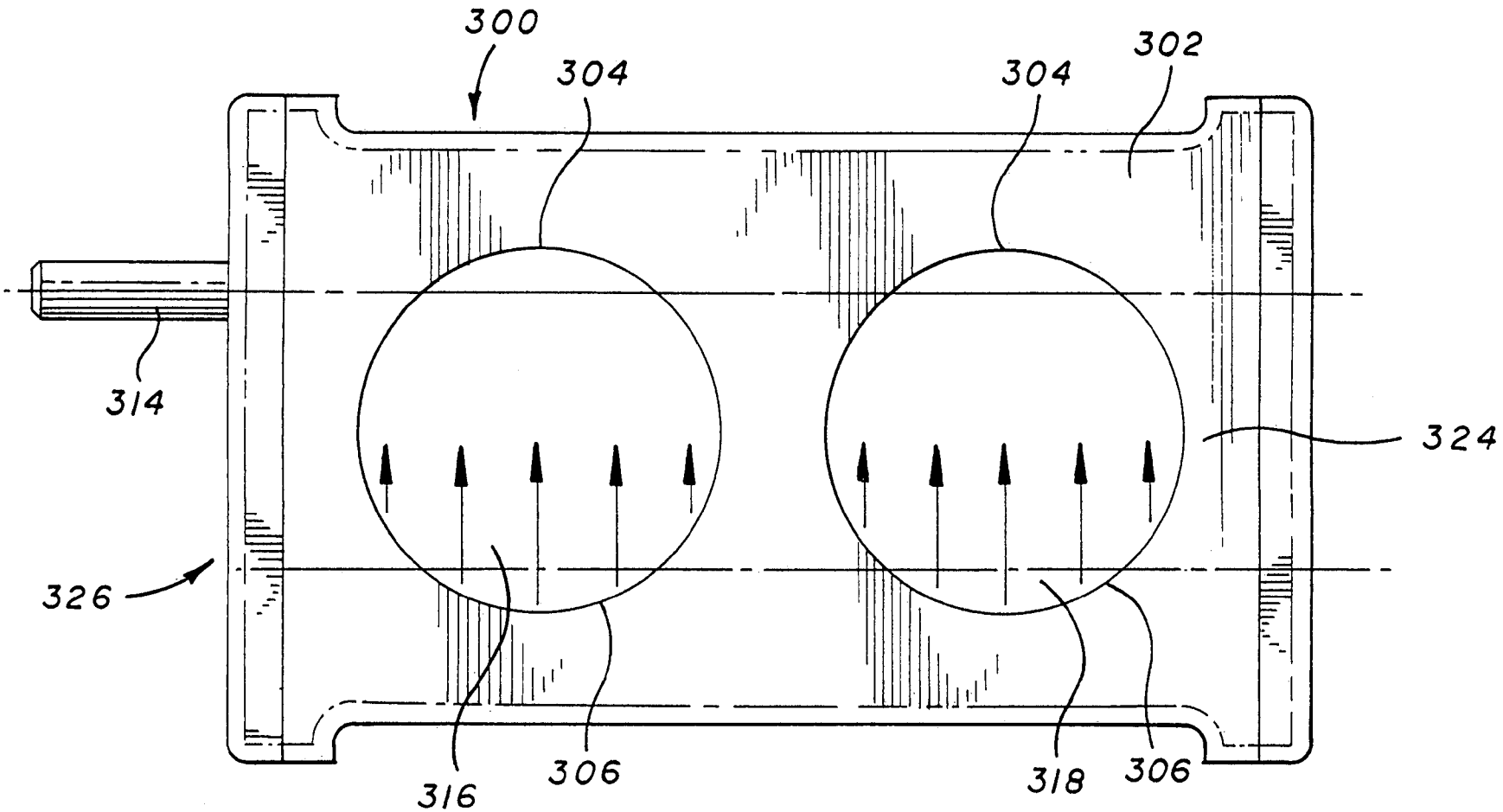
FIG. 3A illustrates a perspective view of the variable valve in an open position according to the preferred embodiment of the present invention.

FIG. 3A illustrates a perspective view of the variable valve 300 in an open position according to the preferred embodiment of the present invention. As described above in relation to FIG. 2A, the maximum amount of flow is able to pass through the channel when the first aperture 205 and the second aperture 203 are preferably configured to form a complete circular opening. Since the passage 316 and 318 of the block body 302 are preferably circular in shape, the first and second apertures 205 and 203 will be configured to be in communication with passage 316 when the valve 300 is in the open position, as shown in FIG. 3A. Similarly, the third and fourth apertures 207 and 209 are configured to be in communication with the passage 318 when the valve 300 is in the open position. Thus, the maximum amount of flow is able to flow through the passages 316 and 318 when the valve 300 is in the open position and the channel has the largest dimension.

Figure 3B:
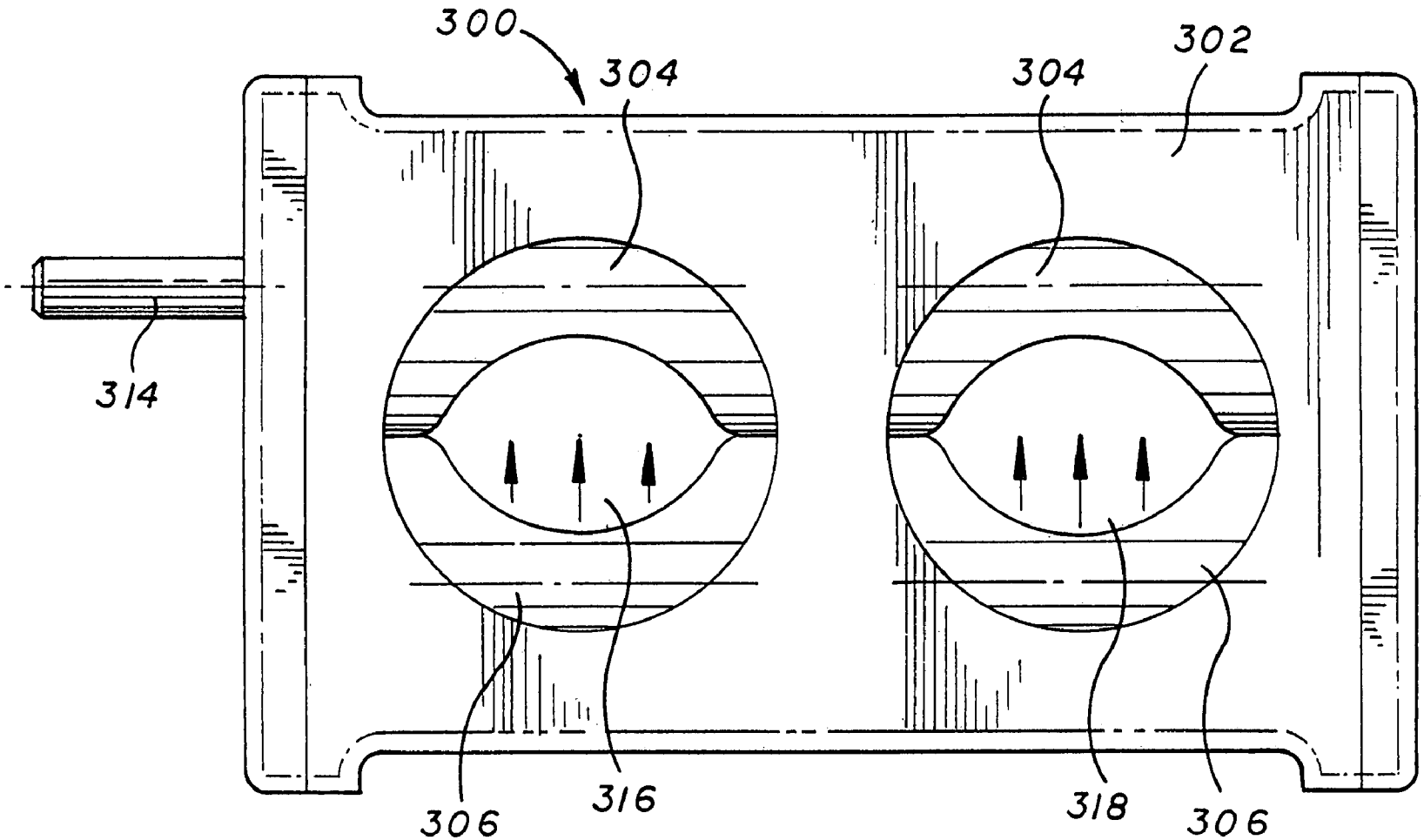
FIG. 3B illustrates a perspective view of the variable valve in an intermediate position according to the preferred embodiment of the present invention.

FIG. 3B illustrates a perspective view of the variable valve 300 within the block in an intermediate position according to the preferred embodiment of the present invention. As shown in FIG. 3B, the block 302 includes two passages 316 and 318 and the first barrel 304 as well as the second barrel 306 positioned within the block 302. The valve apparatus 300 shown in FIG. 3B is in an intermediate position, because the channel is not in complete communication with the passages 316 and 318. Thus, an intermediate amount of flow between the minimum and maximum able to pass through the passages 316 and 318.

Figure 3C:
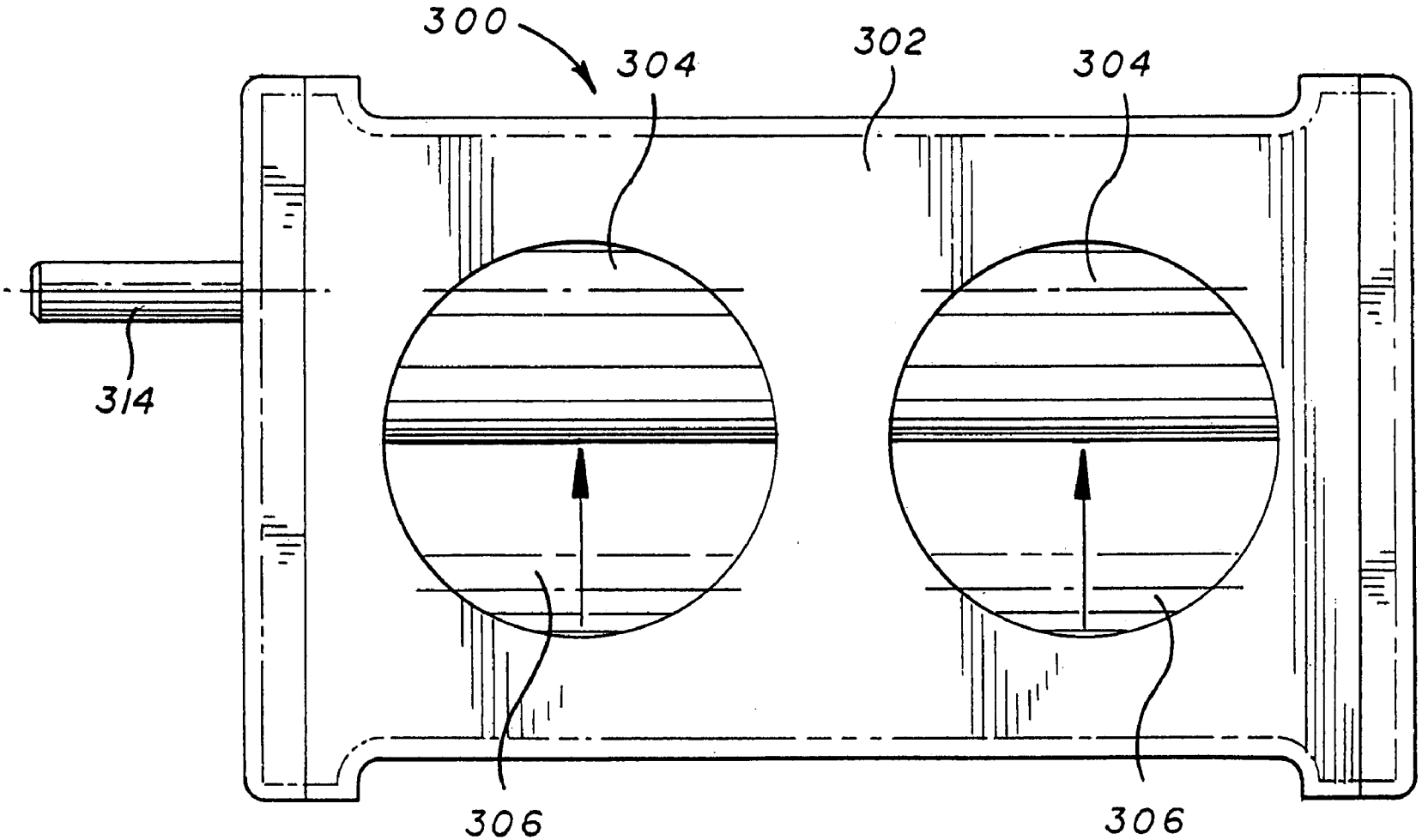
FIG. 3C illustrates a perspective view of the variable valve in a closed position according to the preferred embodiment of the present invention.

FIG. 3C illustrates a perspective view of the variable valve 300 in a closed position according to the preferred embodiment of the present invention. As described above in relation to FIG. 2C, the minimum amount of flow is able to pass through the first barrel 204 and the second barrel 206, because there is no channel though which the flow is able to pass. Therefore, only a predetermined minimum amount of flow is able to pass though the passage 316 and 318.

The operation of the variable valve of the present invention will now be discussed in view of FIGS. 3A–3C. In the exemplary embodiment shown, the valve 300 is placed in an automobile engine, wherein the block 302 is configured such that air enters through the passages 316 and 318 on the front side 324 and exits through the passages on the back side of the block 326. Once the air exits the block 302, the air mixes with fuel which is discharged by the fuel injectors. In FIG. 3C, the engine is preferably in an idle state whereby the valve 300 is in a closed position. As described above, only a predetermined minimum amount of air passes between the first barrel 30 and the second barrel 306, due to a small amount of space between the first barrel 304 and the second barrel 306 in the closed position. As the throttle is increased, the axle 314 rotates in response to the gas pedal being depressed. The rotation of axle 314 causes the first barrel 304 to rotate in the same direction as the axle 314 and along axis 99. The first gear, which is coupled to the first barrel 304, also rotates about axis 99. Since the first gear and the second gear are geared together, the rotation of the first gear causes the second gear to rotate in cooperation with the first gear. As described above, the first gear and the second gear preferably rotate in the opposite direction from one another.

Alternatively, the first gear and the second gear rotate in the same direction with one another by use of a gear train (not shown).

As the second gear rotates about axis 98, the second barrel 306 also rotates about axis 98. As described above, the first gear and the second gear may be of the same size and dimension. Therefore, both barrels 304 and 306 rotate at the same rate and distance with respect to one another. Alternatively, the barrels 304 and 306 may be configured such that one barrel rotates at a different rate and distance from the other barrel.

As the first barrel 304 rotates with the axle 314, the second barrel 306 preferably rotates the same distance in an opposite direction. Thus, as the axle 314 rotates further, the apertures of the first barrel and the second barrel begin to enlarge the passage due to the rotation of ht barrels, thereby forming a channel. At this point, the valve 300 is in an intermediate position, whereby some air then passes through the channels as well as the passages of the block 302. In an electrically charged engine the engine management system in the engine can determine the desired dimension of the channel and the amount of air passing through the block 30 and cause the appropriate amount of fuel to be released and mix with the air before the mixture is sent to the cylinders.

As the throttle is further advanced, the axle 314 rotates further, thereby causing the first barrel 304 and the second barrel 306 to rotate further about their respective axes. The further rotation of the first and second barrels 304 and 306 cause the apertures to rotate such that the channel becomes larger. As the channel becomes larger, more air is allowed to pass through the passage, because there is less obstruction of the barrels in the passage. At full throttle, the first barrel 304 and the second barrel 306 are rotates such that the apertures form a circular channel that is in complete communication with the passages. The valve 300 is in an open position at this point, whereby the maximum amount of air passes through the passages and the channels. In this manner, the first barrel 304 and the second barrel 306 are rotated relative to each other to provide the appropriate amount of flow through the variable throttle valve of the present invention.

The present invention has been described in terms specific embodiments incorporating details to facilitate the understanding of the principles of construction and operation of the invention. It will be apparent to those skilled in the art that modifications may be made in the embodiments chosen for illustration without departing from the spirit and scope of the invention. Accordingly, reference herein to specific embodiments and details thereof is not intended to limit the scope of the claims appended hereto.

What is claimed is:

1. A variable valve, comprising:

a valve body comprising at least one conduit defined therethrough;

a first cylinder having a first aperture corresponding to each of the at least one conduit, wherein the first cylinder is rotatable within the valve body between a first position and a second position; and a second cylinder directly coupled with the first cylinder having a second aperture corresponding to each of the at least one conduit, wherein the second cylinder is rotatable within the valve body between the first position and the second position;

such that the first aperture and the second aperture form a single variable sized opening corresponding to each of the at least one conduit when the first cylinder and the second cylinder move from the first position toward the second position;

wherein each of the single variable sized openings define a cross section by which a passage through the respective conduit is unrestricted;

wherein flow through each of the single variable sized openings is maximized when the first cylinder and the second cylinder are in the second position; and wherein each of the single variable sized openings are in a closed position when the first cylinder and the second cylinder are in the first position.

2. The valve of claim 1, wherein the variable valve comprises a process valve.

3. The valve of claim 1, wherein the variable valve comprises an air valve.

4. The valve of claim 1, wherein the variable valve variable flow for any of a gas and a liquid.

5. The valve of claim 1, wherein the second cylinder moves in cooperation with the first cylinder.

6. The valve of claim 5, further comprising a gear assembly, comprising:

a first set of gears coupled to the first cylinder; and a second set of gears coupled to the second cylinder, wherein the first set of gears and the second set of gears are coupled to one another.

7. The valve of claim 1, wherein the first cylinder and the second cylinder are coupled to the valve body and configured in a predetermined position such that the variable sized opening is in communication with the at least one conduit.

8. The valve of claim 1, further comprising an axle for driving the first cylinder and the second cylinder, wherein the axle is coupled to the block body.

9. The valve of claim 1, wherein the first cylinder and the second cylinder move in an opposite direction from one another.

10. The valve of claim 1, wherein the first cylinder and the second cylinder move in the same direction with one another.

11. The valve of claim 1 wherein the first cylinder rotates about an axis.

12. The valve of claim 1 wherein the second cylinder rotates about an axis.

13. A variable valve apparatus, comprising:

a body having at least one conduit;

a first cylinder coupled to the body, the first cylinder having a first aperture cut therethrough corresponding to each of the at least one conduit, wherein the first cylinder is rotatable between an open position and a closed position; and a second cylinder coupled to the body and directly coupled with the first cylinder, the second cylinder having a second aperture cut therethrough corresponding to each of the at least one conduit, wherein the second cylinder is configured to rotate between an open position and a closed position;

whereby the first aperture and the second aperture form a single variable sized opening corresponding to each of the at least one conduit;

wherein the first aperture and the second aperture define a single variable sized opening corresponding to each of the at least one conduit by which a passage through the at least one conduit is unrestricted;

wherein flow through each of the single variable sized openings is maximized when the first cylinder and the second cylinder are in the open position; and wherein the first aperture and the second aperture do not form the single opening when the first cylinder and the second cylinder are in the respective closed positions.

14. The valve apparatus of claim 13, wherein the variable valve comprises a process valve.

15. The valve apparatus of claim 13, wherein the variable valve comprises an air valve.

16. The valve apparatus of claim 13, wherein the variable valve provides variable flow for any of a gas and a liquid.

17. The valve apparatus of claim 13, wherein the at least one conduit comprises a process passage through the body, the first rotatable cylinder and the second rotatable cylinder, and further wherein the process passage is coupled to the body and configured in a predetermined position such that the at least one conduit is in communication with the process passage.

18. The valve apparatus of claim 13, further comprising an axle coupled to the body for driving the first rotatable cylinder and the second rotatable cylinder.

19. The valve apparatus of claim 13, further comprising a gear assembly comprising:

a first set of gears coupled to the first rotatable cylinder; and a second set of gears coupled to the second rotatable cylinder, wherein the first set of gears and the second set of gears are geared to one another.

20. The valve apparatus of claim 13, wherein the first rotatable cylinder and the second rotatable cylinder move in an opposite direction from one another.

21. The valve apparatus of claim 13, wherein the first rotatable cylinder and the second rotatable cylinder move in a same direction with one another.

22. The valve apparatus of claim 13, wherein the first aperture and the second aperture are both semi-circular and together form a circular opening.

23. A variable valve apparatus comprising:

a body having at least one passage defined therethrough;

a first cylinder coupled to the body, the first cylinder having a first aperture corresponding to each of the at least one passage and configured to move between a first position and a second position; and a second cylinder coupled to the body and directly coupled with the first cylinder, the second cylinder having a second aperture corresponding to each of the at least one passage and configured to move between the first position and the second position;

such that the first aperture and the second aperture form a single variable sized opening corresponding to each of the at least one passage when the first cylinder and the second cylinder move between the first position and the second position;

such that in the respective first positions, the first aperture and the second aperture define a closed position to cut off flow, and in the respective second positions, the first aperture and the second aperture define a single variable sized opening corresponding to each of the at least one passage by which each of the passages is unrestricted, wherein flow through each of the single variable sized openings is maximized.

24. The valve apparatus of claim 23, wherein the variable valve comprises a process valve.

25. The valve apparatus of claim 23, wherein the variable valve comprises an air valve.

26. The valve apparatus of claim 23, wherein the variable valve provides variable flow for any of a gas and a liquid.

27. The valve apparatus of claim 23, wherein the body is configured to allow a maximum amount of flow through the each of the at least one passage when in the second position.

28. The valve apparatus of claim 23, further comprising an axle for driving the first cylinder and the second cylinder, wherein the axle is coupled to the body.

29. The valve apparatus of claim 23, further comprising a gear assembly comprising:

a first set of gears coupled to the first cylinder; and a second set of gears coupled to the second cylinder, wherein the first set of gears and the second set of gears are coupled to one another.

30. A valve apparatus of claim 23, wherein the first cylinder and the second cylinder are configured to rotate in cooperation with one another whereby the first aperture and the second aperture form the single variable sized opening between the first position and the second position.

31. The valve apparatus of claim 23, wherein the first cylinder and the second cylinder rotate in an opposite direction from one another.

32. valve apparatus of claim 23, wherein the first cylinder and the second cylinder move in a same direction with one another.

33. A method of assembling a variable valve apparatus having an open position and a closed position, comprising the steps of:

providing a body having at least one conduit defined therethrough;

coupling a first cylinder to the body, the first cylinder having a first aperture corresponding to each of the at least one conduit and configured to be moveable such that the first aperture is in complete communication with the at least one conduit in the open position; and coupling a second cylinder to the body and directly coupled with the first cylinder, the second cylinder having a second aperture corresponding to each of the at least one conduit and configured to be moveable such that the second aperture is in complete communication with the at least one conduit in the open position;

wherein the first aperture and the second aperture define a single variable sized opening corresponding to each of the at least one conduit by which a flow through the respective conduit is unrestricted when the first aperture and the second aperture are in the open position, such that flow through each of the single variable sized openings is maximized; and wherein the first aperture and the second aperture are not in communication with the at least one conduit when the first aperture and the second aperture are in the closed position.

34. The method of claim 33, wherein the variable valve apparatus comprises a process valve.

35. The method of claim 33, wherein the variable valve apparatus comprises an air valve.

36. The method of claim 33, wherein the flow comprises any of a gas and a liquid.

37. The method of claim 33, wherein the body includes means for driving the first cylinder and the second cylinder, wherein the means for driving is coupled to the body.

38. The method of claim 33, wherein the body further comprises a gear assembly including:

a first set of gears coupled to the first cylinder; and a second set of gears coupled to the second cylinder, wherein the first set of gears and the second set of gears are coupled to one another.

39. The method of claim 33, wherein the first cylinder and the second cylinder move in an opposite direction from one another.

40. The method of claim 33, wherein the first cylinder and the second cylinder move in a same direction with one another.

41. The method of claim 33, wherein the first cylinder is rotatably moveable about an axis.

42. The method of claim 33, wherein the second cylinder is rotatably moveable about an axis.

43. A valve comprising:

a body;

a first means for channeling a flow through the body; and a second means for channeling the flow though the body;

wherein the first means and the second means are configured to directly couple one another and to rotatably move in an opposite direction from one another, thereby forming at least one variable sized aperture; and wherein the first means and the second means define a single variable sized opening for each of the variable sized apertures by which the channeled flow through the body is unrestricted when the first means and the second means are in an open position to maximize flow through each of the single variable sized apertures, and wherein the first means and the second means define a cross section by which the channeled flow through the body is completely closed when the first means and the second means are in a closed position.

44. The valve of claim 43, wherein the valve comprises a process valve.

45. The valve of claim 43, wherein the valve comprises an air valve.

46. The valve of claim 43, wherein the flow comprises any of a gas and a liquid.

47. A variable valve comprising:

a first rotatable cylinder having a first aperture, wherein the first rotatable cylinder rotates between a first position and a second position;

a second rotatable cylinder having a second aperture, wherein the second rotatable cylinder is directly coupled to the first rotatable cylinder and rotates in cooperation with the first rotatable cylinder such that the first aperture and the second aperture form at least one single variable sized opening when the first rotatable cylinder rotates from the first position toward the second position;

wherein the first rotatable cylinder and the second rotatable cylinder define a cross section by which a flow through the single variable sized opening is unrestricted when the first rotatable cylinder is in the second position to maximize flow through each of the single variable sized apertures, and wherein the first rotatable cylinder and the second rotatable cylinder define a cross section by which the flow is closed when the first rotatable cylinder is in the first position.

48. The valve of claim 47, wherein the variable valve comprises a process valve.

49. The valve of claim 47, wherein the variable valve comprises an air valve.

50. The valve of claim 47, wherein the flow comprises any of a gas and a liquid.

51. The valve of claim 47, further comprising a block body including a passage for allowing a process to pass through the block body, the first rotatable cylinder and the second rotatable cylinder, wherein the passage is configured in a predetermined position such that the single variable sized opening is in communication with the passage.

52. The valve of claim 47, further comprising an axle for driving the first rotatable cylinder and the second rotatable cylinder, wherein the axle is coupled to the block body.

53. The valve of claim 47, further comprising a gear assembly comprising:

a first set of gears coupled to the first rotatable cylinder; and a second set of gears coupled to the second rotatable cylinder, wherein the first set of gears and the second set of gears are coupled to one another.

54. The valve of claim 47, wherein the first rotatable cylinder and the second rotatable cylinder rotate in an opposite direction from one another.

55. The valve of claim 47, wherein the first rotatable cylinder and the second rotatable cylinder rotate in a same direction with one another.

56. A variable valve apparatus having an open position and a closed position, comprising:

a body having at least one conduit defined therethrough;

a first cylinder coupled to the body, the first cylinder having a first aperture corresponding to each of the at least one conduit and configured to be moveable such that the first aperture is in complete communication with the at least one conduit in the open position; and a second cylinder coupled to the body and directly coupled with the first cylinder, the second cylinder having a second aperture corresponding to each of the at least one conduit and configured to be moveable such that the second aperture is in complete communication with the at least one conduit in the open position;

wherein the first aperture and the second aperture define a single variable sized opening corresponding to each of the at least one conduit in the open position which does not restrict a passage of a flow through the respective conduit, such that flow through each of the single variable sized openings is maximized; and wherein the first aperture and the second aperture are not in communication with the at least one conduit when the first aperture and the second aperture are in the closed position.

57. The apparatus of claim 56, wherein the variable valve comprises a process valve.

58. The apparatus of claim 56, wherein the variable valve comprises an air valve.

59. The apparatus of claim 56, wherein the flow comprises any of a gas and a liquid.

60. The apparatus of claim 56, wherein the body comprises means for driving the first cylinder and the second cylinder, wherein the means for driving is coupled to the body.

61. The apparatus of claim 56, wherein the body further comprises a gear assembly including:

a first set of gears coupled to the first cylinder; and a second set of gears coupled to the second cylinder, wherein the first set of gears and the second set of gears are coupled to one another.

62. The apparatus of claim 56, wherein the first cylinder and the second cylinder move in an opposite direction from one another.

63. The apparatus of claim 56, wherein the first rotatable cylinder and the second rotatable cylinder rotate in a same direction with one another.

64. The apparatus of claim 56, wherein the first cylinder is rotatably moveable about an axis.

65. The apparatus of claim 56, wherein the second cylinder is rotatably moveable about an axis.

* * * * *